United States Patent [19]

Bauer et al.

[11] 4,020,974

[45] May 3, 1977

[54] BB SHOT CONTAINER AND DISPENSING FILLER

[76] Inventors: Martin G. Bauer; Betty A. Bauer, both of Rte. No. 1, Box No. 15, Bismarck, N. Dak. 58501

[22] Filed: Jan. 15, 1976

[21] Appl. No.: 649,188

[52] U.S. Cl. ..... 221/307; 222/213; 222/572; 124/50; 42/87

[51] Int. Cl.[2] ..... F41C 25/00; A47F 1/00

[58] Field of Search ..... 221/307, 312 C, 303, 221/306; 222/213, 528, 572, 456; 206/536; 124/45, 49, 50; 42/87, 88

[56] References Cited

UNITED STATES PATENTS

| | | | |
|---|---|---|---|
| 1,955,559 | 4/1934 | Narrow | 221/309 |
| 2,546,709 | 3/1951 | Abarr | 222/213 |
| 2,778,544 | 1/1957 | King | 222/456 |
| 3,373,520 | 3/1968 | Into | 124/45 |

FOREIGN PATENTS OR APPLICATIONS

| | | | |
|---|---|---|---|
| 1,074,284 | 3/1954 | France | 221/307 |

*Primary Examiner*—Robert B. Reeves
*Assistant Examiner*—Frederick R. Handren
*Attorney, Agent, or Firm*—Dowell & Dowell

[57] ABSTRACT

A container for BB shot or other spherical pellets having a dispensing filler portion, useful for example for filling an air rifle, and having a container portion serving as a sales package and/or storage device, said dispensing filler portion comprising a tube of internal diameter slightly larger than the BB shot, and the filler portion being joined to a wall of the container portion by a transfer portion having a transfer slot which is about equal in width and in depth to the inner diameter of the filler tube and the slot length being at least equal to several BB diameters, the transfer slot serving to reduce bridging while the dispensing filler tube portion is being filled from the container portion, the tube portion being distorted to restrict it internally at a location near its discharge end which distortion can be manually straightened to dispense BBs therethrough, and the portions being made of transparent plastic so that the user can see when the tube portion is filled with BBs and can see his remaining supply.

5 Claims, 5 Drawing Figures

BB SHOT CONTAINER AND DISPENSING FILLER

FIELD OF INVENTION

This invention relates to a container and filler tube device for containing spherical objects such as BB shot, and dispensing them when a distorted location near the discharge end of the filler tube is manually straightened.

BACKGROUND AND PRIOR ART

This invention seeks to solve the problem of providing a very inexpensive packaging device for containing a very inexpensive product such as BB shot, the package also providing a dispensing filler tube intended to obviate the common practice among children of placing BB shot in their mouths and filling the magazine of an air rifle by pressing their lips against it and expelling the BBs thereinto.

The prior art shows a number of different containing and dispensing devices for small objects such as BB shot, pills, etc. U.S. Pat. No. 2,515,378 to Nicolle shows a small flat package for containing non-circular cross-section pills or tablets and for dispensing them one at a time through an opening while collimating a row of pills to be thus dispensed using longitudinal ribs in the package for aligning the pills. This device dispenses essentially one pill at a time rather than a large number of pills, and this fact is in opposition to the extent of the present dispensing filler tube which dispenses a number of BBs comprising a "full load" of shot.

U.S. Pat. No. 1,955,559 to Narrow, and U.S. Pat. No. 3,263,664 in which the applicants are the inventors, show BB shot dispensing containers having tubes for dispensing the shot, U.S. Pat. No. 1,955,559 having a tube which is squeezed in order to enlarge its opening to permit the shot to pass through. However, it has been the experience of the applicants who manufacture such containers that there is a serious problem of bridging of the BB shot at the entrance of the tube which tends to interrupt the flow of BB shot into the gun before the magazine of the gun has been filled. This requires shaking of the container while filling the rifle, which often results in loss of BB shot when the end of the filler tube pops out of the gun magazine accidentally.

U.S. Pat. No. 3,481,513 to Ram shows another pill dispenser in which a portion of the dispenser is squeezed in order to drop a pill therefrom.

U.S. Pat. No. 2,456,159 to Tratsch shows tubes containing BB shot wherein the end of the tube is annularly restricted sufficiently to prevent the BBs from dropping accidentally from the tube, this type of cartridge being used with a specially built gun in which it is inserted. However, manual squeezing of this cartridge tube will not dispense BB shot in the manner intended in the present invention.

THE INVENTION

The present invention comprises a BB shot container and dispensing filler having a storage container portion for storing a large number of BB shot, and having a dispensing filler tube portion located adjacent to the container portion and of sufficient length to hold a load of BB shot within its bore which is only slightly larger than the diameter of the BB shot. A transfer portion joins the container portion with the filler tube portion and includes a transfer slot communicating from the container portion into the bore of the filler tube portion, the transfer slot being a little wider than the diameter of a BB, and extending through a depth from the container to the tube portion which is about equal to a BB diameter, and being as long at least as several diameters of a BB, the transfer slot functioning to discourage bridging of the BBs as they pass from the container into the bore of the filler tube portion, which bridging causes clogging while filling the dispensing filler tube. The filler tube has a closure cap at its discharge end used primarily during shipping and having a distorted portion near its discharge end which can be manually straightened, for instance, by pinching in order to restore the circular cross-section of the bore at the distorted location, thereby allowing the BBs to pass rapidly from the tube to the magazine of an air rifle.

It is a principal object of the invention to provide an improved container and dispensing filler for BB shot or other spherical objects, and for making the filling of an air rifle easier and more convenient, while at the same time accomplishing this purpose in a manner providing a package which is highly economical to manufacture.

It is another major object of the invention to provide a container and dispensing filler of the type specified wherein the transfer slot is of sufficient cross-sectional size to accept a row of at least several BBs within the slot with these BBs sitting on top of other BBs which may be already located in the bore of the filler tube when the latter is full. This construction makes bridging much less likely than would be the case if the filler tube merely open directly into the container without a transfer slot interposed therebetween where the transfer slot is equal in depth as measured radially of the container to another BB diameter. Experience has shown that when the filler tube is in the process of being filled from the container while shaking the container back and forth in the direction of the axis of the filler tube with that axis disposed essentially horizontal, bridging does not tend to occur. This is because there are always at least some balls in the transfer slot even though there may be some bridging between the slot and the interior of the container portion. Thus, when the device is shaken in a manner to cause the BBs in the filler tube to run toward the discharge end, any balls which are located in the transfer slot must necessarily drop through into the filler tube bore. Such a dropping of the balls in the transfer slot appears to undermine any bridging which has occurred at the exit from the container into the transfer slot and cause re-filling of the transfer slot. The transfer slot provides a degree of freedom of motion for the balls located therein which is at 90° with respect to the degree of freedom of motion available to any balls located in the bore of the filler tube, and the combination of these differently oriented degrees of freedom, which are perpendicular to each other, provides an anti-bridging action which is unexpectedly efficient in preventing bridging during filling of the bore of the filler tube from the container.

Another object of the invention is to provide a transparent structure permitting the user of the dispensing container to see when the BB shot balls have completely filled the filler tube while the tube is being loaded from the container, and also to see the balls located within the container so that the remaining supply is clearly visible.

Still another object of the invention is to provide an extremely inexpensive and efficient means for valving the discharge of the BB shot from the bore of the filler tube when the filler tube has been provided with a "full load" of shot, this valving action being accomplished merely by distorting or partially collapsing the filler tube in a position near the discharge end thereof in a manner such that a person can restore the circular cross-section of the bore of the tubing by manually pinching the tubing from the outside in order to straighten its walls.

Another object of the invention is to provide a device of the character specified in which the valving means is at a location spaced from the discharge end of the filler tube by at least several BB diameters, whereby an undistorted discharge end remains on the tube which can be inserted into the magazine of an air rifle while filling it, at the same time leaving the distorted valving portion outside of the magazine for easy access by the user's fingers.

Another object of the invention is to provide a cap for closing the discharge end of the tube during shipping of the device and its use as a sales container, the cap extending far enough onto the discharge tube that it is frictionally maintained thereon by the distorted portion of the tube pressing against the inner wall of the cap.

Yet another object of the invention is to provide a container and dispensing filler in which the container may either be closed by a closure at one of its ends closing an opening used for filling the container during packaging, or else the container portion can be made entirely enclosed and subsequently filled with BB shot through the dispensing end of the filler tube portion.

Other objects and advantages of the invention will become apparent during the following discussion of the drawing, wherein:

THE DRAWING

Figure 1:
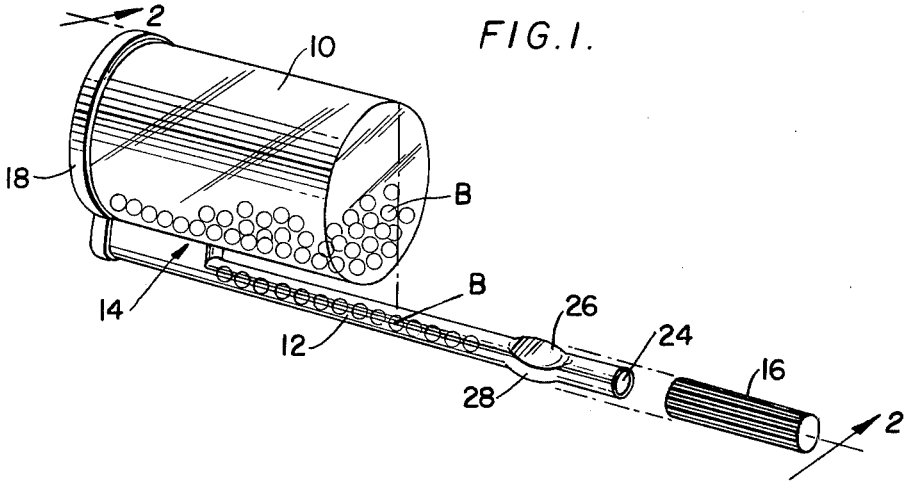
FIG. 1 is a perspective view of an embodiment of a BB shot container and dispensing filler together with a closure cap for closing the dispensing end of the latter.
Figure 2:
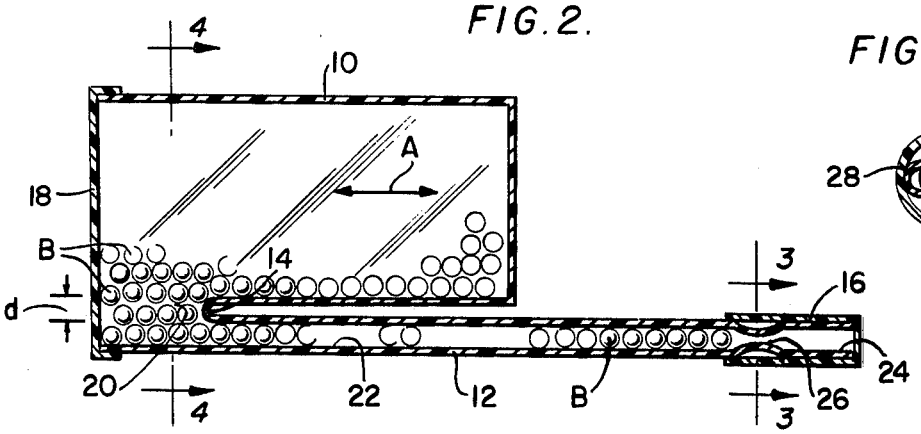
FIG. 2 is a cross-sectional view taken along line 2—2 of FIG. 1 and showing the cap in closed position.

Referring now to the drawing, FIGS. 1 and 2 show the BB shot container and dispensing filler which comprises a main container portion 10, a filler tube portion 12, a transfer portion 14, a cap 16, and a closure 18 for closing the container. The closure 18 can of course be manufactured to close the opposite end of the container portion 10 as an optional variation. The members 10, 12, and 14 are preferably made of transparent plastic so that the user can see the BB shot located therewithin as an indication of how much shot remains in the reserve, and as an indication of when the filler tube portion 12 has been completely filled with BB shot.

Figure 4:
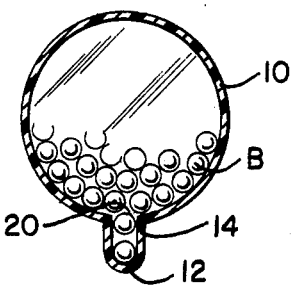
FIG. 4 is a cross-sectional view taken along line 4—4 of FIG. 2.
Figure 5:
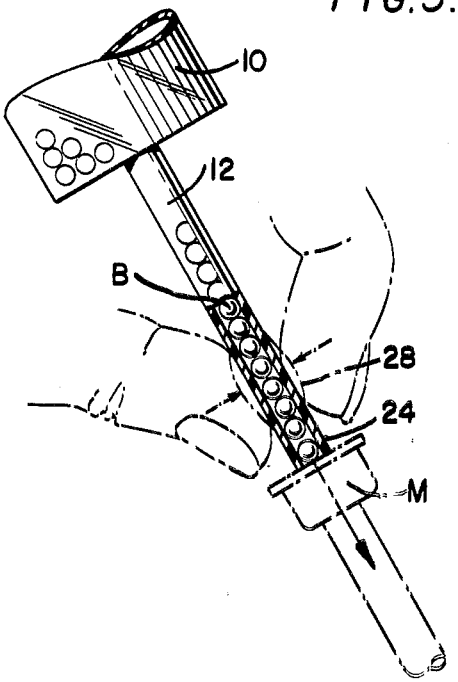
FIG. 5 is a partial view of the device showing the end of the discharge tube inserted in the magazine of an air rifle with the user's fingers pinching the valving means so as to restore the circular cross-sectional shape of the tubing at its distorted location.

The transfer portion 14 of the structure provides a transfer slot 20 which is about the same width as the diameter of the bore 22 of the tubing portion 12. This fact can be seen best in the lower portion of FIG. 4. The length of the slot as measured parallel to the axis of the bore 22 and the axis A of the cylindrical container 10 should be at least several diameters of the BB shot B and in the present illustration the length of the slot is about equal to 4 diameters, or slightly larger. The proportioning of the device is such that the depth d of the slot is about equal to the diameter of the bore 22, or perhaps slightly smaller. Thus, it is approximately 2 diameters of a BB from the inside surface of the container 10 to the far wall of the bore 22 as viewed in FIGS. 2 and 4.

Assuming that the bore 22 is not yet completely filled with BBs, the balls located within that bore beneath the slot 20 have a degree of freedom to move only in one or the other axial directions with respect to the bore 22. On the other hand, any balls which are located within the slot 20 have a degree of freedom to move which is essentially vertical as viewed in the drawing of FIG. 2, so that the balls in the slot 20 enjoy a direction of freedom of motion which is perpendicular to the direction of freedom of motion of the balls in the bore 22 beneath the slot 20, although the balls in the slot 20 may also have a horizontal component of motion in a direction parallel to the axis of the bore 22. The presence of the slot 20 in addition to the bore 22, therefore, provides an additional freedom of motion oriented at right angles to the motion of the balls in the bore 22, and this additional freedom of motion provided by the slot 20 reduces the tendency of the balls to bridge as they exit from the container portion 10, whereby the filling of the bore 22 in the dispensing filler portion 12 occurs easily and rapidly. During use of the device it is recommended that the user shake the device back and forth in the direction of the axis A of the container portion 10 while holding the device with the bore of the filler portion 12 oriented below the container portion 10 essentially in the horizontal position as shown in FIG. 2.

The balls are prevented from prematurely exiting from the discharge end 24 of the tubing portion 12 by the deliberate distortion of the plastic in the location designated by the reference character 26. In the present illustrative embodiment, the tubing is distorted inwardly at 26 from at least one side in order to provide a partially collapsed portion of the tubing. In the drawing, the tubing is actually collapsed from two opposite sides so as to restrict the inner diameter of the bore 22, the memory of the plastic maintaining the distorted shape. When the BBs are to be allowed to run from the bore 22 of the filler 12 into the magazine M of an air rifle (not shown), the sides 28 of the tubing in the vicinity of the distorted portion 26 are squeezed inwardly, whereby the tubing is returned to essentially cylindrical form at the distorted location 26, thereby permitting the balls to pass freely into the magazine M. This is easily accomplished by pinching with the fingers.

Figure 3:
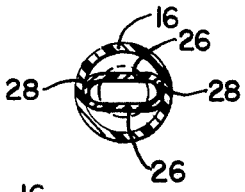
FIG. 3 is an enlarged cross-sectional view taken along line 3—3 of FIG. 2.

FIG. 3 shows the tubing distorted inwardly at 26, which makes it bulge outwardly at 28, and this outward bulge normally maintains the cap 16 in place by tight frictional engagement therewith. The closure 18 can be cemented or heat sealed to close the container portion 10 at the factory after the BB shot has been loaded into the container portion 10. The length of the filler portion 12 determines the number of BBs which it will hold in its bore 22, and this length 12 should be selected so as to provide either a full load for an air rifle, or else a sub-multiple thereof. When it is desired to load only the number of BBs into a rifle which the tube 12 can hold, the user can turn the device upside down so that the container portion 10 is beneath the dispensing filler tube portion 12. In this position, as the filler tube 12 begins to empty no additional BBs will enter the tube 12 from the container portion through the transfer slot 20.

This invention is not to be limited to the exact form shown in the drawing, for obviously, changes may be made therein within the scope of the following claims:

We claim:

1. A container for BB shot having a dispensing filler for filling an air rifle, comprising:

a. a container portion having internal dimensions which are large compared with the diameter of a BB and having an outer wall;

b. a filler tube portion located offset from and adjacent to said outer wall, the tube portion having an inner bore diameter slightly larger than the diameter of a BB and of length much greater than said diameter whereby a number of BBs can be aligned in the bore for delivery to said rifle; and c. a transfer portion having side walls joining the tube portion with the container portion at its outer wall, the transfer portion having a transfer slot between opposed side walls, the slot joining the bore of the tube portion with the inside of the container, the slot being about as wide as the diameter of the bore of the tube portion and of length measured along said bore greater than twice the diameter of a BB but smaller than the length of the tube portion;

d. the container portion being cylindrical and having an axis extending parallel to said bore of the tube portion, the tube portion being long as compared with the axial length of the container portion, said portions being made of resilient transparent plastic, and the tube portion being distorted at a location near its discharge end which is remote from said transfer portion to prevent the discharge of said BBs unless the tube is manually straightened.

2. A container and filler as set forth in claim 1, wherein said container portion is open at one of its axial ends; and closure means closing said open end.

3. A container and filler as set forth in claim 1, further including a cap for closing the discharge end of the tube portion, the cap comprising a cylinder closed at one end and slidable over the tube portion, the cylinder being long enough to engage the distorted location of the tube portion and be frictionally retained thereby on the tube portion.

4. A container and filler as set forth in claim 1, wherein the distorted location is spaced from the discharge end of the tube portion by several BB diameters.

5. A container for BB shot having a non-clogging dispensing filler for filling an air rifle, comprising:

a. a container portion having internal dimensions which are large compared with the diameter of a BB and having a container wall;

b. a filler tube portion located adjacent to said container wall, the tube portion having a tube wall surrounding an inner bore of diameter slightly larger than the diameter of a BB, and the tube portion being of length greater than the container portion, whereby a number of BBs can be aligned in the bore for delivery to said rifle;

c. the tube portion having a discharge end which is distorted to oppose the dispensing of BBs but which can be manually straightened, and having at the other end a transfer portion; and d. said transfer portion having a pair of parallel side walls spaced apart by a distance slightly greater than the diameter of a BB and defining a transfer slot therebetween, the opposed side walls opening on one side into the bore of the tube portion and having on the other side an entrance opening into the inside of the container, the distance from the entrance of the slot to the far wall of the tube portion being about twice the diameter of a BB, and the length of the entrance and of the slot measured parallel to said bore being greater than twice the diameter of a BB, but small as compared with the length of the tube portion.

* * * * *